US007515755B2

(12) United States Patent
Littooij et al.

(10) Patent No.: US 7,515,755 B2
(45) Date of Patent: Apr. 7, 2009

(54) METHOD AND DEVICE FOR THE AUTOMATED RECOGNITION OF SEMI-FINISHED PRODUCTS

(75) Inventors: Nico Littooij, Hinwil (CH); Paul Mueller, Greppen (CH)

(73) Assignee: Concast AG, Zurich (CH)

( * ) Notice: Subject to any disclaimer, the term of this patent is extended or adjusted under 35 U.S.C. 154(b) by 352 days.

(21) Appl. No.: 11/279,817

(22) Filed: Apr. 14, 2006

(65) Prior Publication Data

US 2006/0204108 A1 Sep. 14, 2006

Related U.S. Application Data

(63) Continuation of application No. PCT/EP2004/011073, filed on Oct. 5, 2004.

(30) Foreign Application Priority Data

Oct. 16, 2003 (EP) ..... 03023365

(51) Int. Cl.
*G06K 9/68* (2006.01)
*G06K 9/00* (2006.01)
*G06K 9/62* (2006.01)

(52) U.S. Cl. ..... 382/218; 382/141; 382/209

(58) Field of Classification Search ..... 382/141, 382/143, 149, 152, 209, 218; 348/86, 125
See application file for complete search history.

(56) References Cited

U.S. PATENT DOCUMENTS 4,961,149 A * 10/1990 Schneider et al. ..... 700/135
6,184,924 B1 * 2/2001 Schneider et al. ..... 348/92
7,136,513 B2 * 11/2006 Waehner et al. ..... 382/118

FOREIGN PATENT DOCUMENTS

DE 42 30 621 A 3/1994
EP 0 112 256 A 6/1984

OTHER PUBLICATIONS

Patent Abstracts of Japan JP 2000 190257 A published Jul. 11, 2000.

(Continued)

*Primary Examiner*—Daniel G Mariam
(74) *Attorney, Agent, or Firm*—Darby & Darby P.C.

(57) ABSTRACT

Semifinished products, especially strand sections that are cut off from continuous cast strands, are marked in steel mills and rolling mills so that individual pieces can be tracked. The marks applied or attached to the pieces have to be machine-readable in a sorting station. Marking and reading devices are expensive and produce undesired reading errors. The aim of the invention is therefore to create a method and a device that avoid the aforementioned disadvantages and that allow for a reliable and cost-efficient identification of semifinished products. For this purpose, a first camera is used in an identification station to obtain digitized images of optically visible separating section-specific and strand section-specific surface features on an identification surface and the images are stored in a database. A second camera is used in a sorting station to obtain digitized images of the same identification surface and these images are used in the database for an identification by comparing them with the stored images of the first camera.

26 Claims, 2 Drawing Sheets

OTHER PUBLICATIONS

Birks P S, "Automated Tracking Shows True Character", *Steel Times, Fuel & Metallurgical Journals Ltd.*, London, GB, vol. 223, No. 9, Mar. 1, 1995, p. 104, XP000502181.

"Hot Metal Stencilling Systems Provides Clear Recognition", *Steel Times, Fuel & Metallurgical Journals Ltd.* London, GB, vol. 217, No. 1, 1989, p. 38, XP000007326.

Marking Hot, Fast and Small, *Steel Times International.*(*Inc. Steel Times*), *DMG World Media*, Redhill, Surrey, GB, vol. 14, No. 6, Nov. 1, 1990, p. 60, XP000174513.

Patent Abstracts of Japan JP 08 271210 A published Oct. 18, 1996.

Mueller T et al, Massnahmen Zur Qualitaetssicherung Bei Der Erzeugung Von Stranggussbrammen, Stahl und Eisen, Verlag Stahleisen GmbH. Dusseldorf, DE, vol. 119, No. 6/7, Jun. 7, 1999, pp. 93-98,232, XP000853043.

International Search Report for PCT/EP2004/011073 mailed Jan. 13, 2005.

* cited by examiner

METHOD AND DEVICE FOR THE AUTOMATED RECOGNITION OF SEMI-FINISHED PRODUCTS

CROSS REFERENCE TO PRIOR APPLICATIONS

This application is a continuation of International Patent Application Serial No. PCT/EP2004/011073, filed Oct. 5, 2004, which claims priority of European Application No. 03023365.4, filed Oct. 16, 2003, both of which are incorporated by reference herein.

BACKGROUND OF THE INVENTION

1. Field of the Invention

The invention concerns a method and a device for carrying out the method for automated recognition of semi-finished products, according to the pre-characterizing clause of claim 1.

2. Description of Related Art

For quality assurance, in a steel and rolling mill individual part tracking of semi-finished products, as part of process and plant monitoring, is indispensable.

During strand casting, all quality-relevant parameters of the casting process can be perfectly assigned to the individual strand section in the cutting station. So that the assignment of these parameters is retained even after the cutting station for every individual strand section, a marking which can be read by the human eye and/or by mechanical optical capture must be put onto the strand sections.

For this purpose, after the cutting station, a marking such as indented numbers, a bar code, a dot code, etc. is put onto the strand sections. Instead of being marked, the strand sections can also be made recoginsable by a sheet metal label with the appropiate data being hung, welded or nailed onto them.

In the prior art, the ability to track strand sections particularly in the case of mechanical reading of markings, is still subject to an error rate which is unsatisfactory in practice. Mechanical reading of an applied marking is understood to mean, on the one hand, geometrical recognition of the marking, and on the other hand the assignment of the semantic content of the geometrically recognised marking. If an error occurs in one of these steps, the mechanical identification of the strand section is unusable. Strand sections which cannot be identified mechanically must be identified by the human eye if possible, or remain unidentifiable and are rejected.

As well as a very wide variety of marking systems, a large number of devices to read the applied markings is known. All these systems are confronted, on the one hand, with the harsh operating environment of the steel mill, and on the other hand with the fact that in general the marking must be applied to the incandescent strand section. It must be possible to recognise markings mechanically and assign the casting parameters to the individual strand section in both the incandescent and the cooled state.

From JP-OS 2000-190257 A, a method of automatic recognition of strand sections after a cutting station of a continuous casting plant, particularly in a subsequent sorting point, is known. In a first step, numbers and/or letters are stamped into the strand section by a stamping machine. In a second step, the numbers and/or letters are recorded photographically by a camera in a first information picture. In a third step, there is a test for whether the semantic or read content of the stamped-in numbers and/or letters is recognisable. In a fourth step, the first information picture is stored together with the data which is specific to the strand section. In a subsequent sorting point, e.g. before the rolling process, a second information picture of the numbers and/or letters stamp is produced by a second camera, and the second information picture is compared with the first information picture by the comparison method and used for identification. This method makes it possible to identify badly readable or unreadable numbers and/or letters stamps, the semantic content of which cannot be completely determined, by means of the comparison method of the unreadable remaining numbers and/or letters. The device to carry out this method requires, as well as the stamping machine, two optical stamp reading machines, and in addition a database and a computer program for comparing the stamped-in numbers and/or letters in the first and second information pictures.

SUMMARY OF THE INVENTION

The invention is based on the object of creating a method and a device for simple, error-free automated recognition of identification data or semi-finished products, particularly of strand sections after the separating cut, in a continuous casting plant, and for use of this identification data for sorting the strand sections for subsequent manufacturing processes. The method and device for recognition of identification data is also intended to increase reliability of identification, to require little space in the plant layout, to be economical, the be possible to automate, and to make the use of expensive marking equipment unnecessary.

For identification of strand sections, the method and device according to the invention use optically recognisable surface features on the cut surface of strand sections. These features were applied to the cut surface by the separating cut, irrespective of the cutting method. For identification, in principle all optically recognisable features can be used, e.g. the geometry of the strand section, surface roughness, texture, microstructural properties and/or cut-specific surface features. The device for identifying strand section is simplified, in particular, in that the pictures in the cutting or identification station are generated by a first camera, and the pictures at the sorting point are generated by a second camera, with essentially the same kind of facilities. Such camera are relatively small and can easily be protected from heat radiation. The identification itself takes place using the digital image data which is processed in the database in the computer room by the comparison method, similarly to the OCV (optical character verifying) method. There is no assignment of semantic or read content in the method according to the invention.

Depending on the cutting method, e.g. flame cutting, shearing machine, laser, plasma, cutoff wheel, different optically recognisable features are applied to the cut surface, which is used as the identification surface. According to an embodiment of the invention, it is specially advantageous if the optically recognisable features are created on the predetermined identification surface by cutting shears or a flame cut.

For various reasons, it can be advantageous to put optically recognisable surface features additionally onto the identification surfaces, which are given identification features by the separating cut. Such additional surface features can show, for instance, the position of the billet in relation to the camera, or make broad sorting by the human eye possible, e.g. in a storage area. According to another embodiment, it can be advantageous if before the first pictures are obtained, additional optically recognisable features such as colour patterns, rust protection patterns, mechanically generated embossed patterns without semantic or read content are applied, and evaluated by the comparison method (like a fingerprint comparison).

To eliminate any light effects of the environment, e.g. in the case of day or night operation, but for instance also to generate a shadow effect which aids identification, it can be advantageous, while obtaining the pictures, to illuminate the identification surface with artificial light. The angle of incidence of the light on the identification surface is set between 8° and 45°, preferably between 12° and 35°.

Depending on the length of the time span between the first picture in the cutting station and the second picture at the sorting point, in general the temperature of the strand section changes. This temperature change is associated with a colour change of the identification surface, and this colour change must be neutralised for the comparison method. According to the one embodiment, it is therefore proposed that when the pictures are obtained, a light spectrum should be filtered out by means of a filter between the identification surface and the camera.

With this method, the small time requirement for obtaining and sorting a picture makes it possible, both in the identification station and in the sorting station, to obtain multiple pictures of the same identification surface with different directions and/or angles of incidence of light, store them in the database, and evaluate them during identification by the comparison method, to increase the reliability of recognition. According to one embodiment, light can be applied to the same identification surface from four sides, with predetermined angles of incidence of light, by means of lamps, the light being applied from a different side for each picture. Because the shadows are thrown differently, the result is four different pictures of the same identification surface. To exclude external light sources, according to a further embodiment, arranging a light screen in the form of a small tunnel or tube at the identification station and sorting station is recommended.

Because of different angles of incidence of light, the way the shadows of unevennesses are thrown on the same identification surface changes. With this method, typical features such as elevations or depressions on the identification surface are available as optical identification features for the comparison method, corresponding to the existing number of obtained pictures.

BRIEF DESCRIPTION OF THE DRAWINGS

The foregoing and other features of the present invention will be more readily apparent from the following detailed description and drawings of an illustrative embodiment of the invention where like reference numbers refer to similar elements throughout the several views and in which.

DESCRIPTION OF EMBODIMENTS OF THE INVENTION

Figure 1:
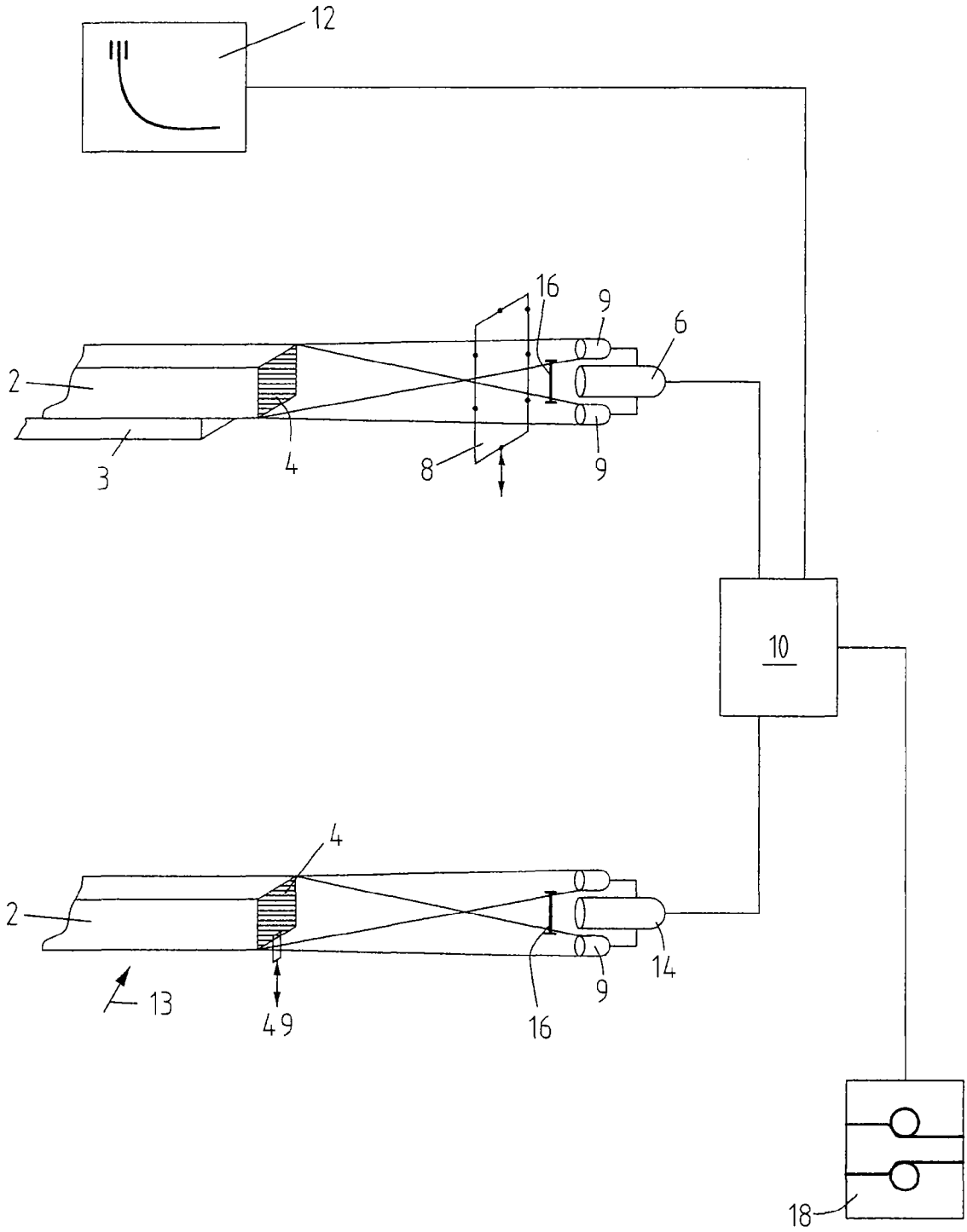
FIG. 1 shows a schematic representation a device for identifying products according to embodiments of the invention.

In FIG. 1, a semi-finished product in the form of a strand section 2 on an identification bed 3 is shown. In this example, the strand section 2 has been separated from the strand by means of diagonal shears (not shown). A cut surface 4 shows traces of being sheared off by the knife of the diagonal shears. These traces on the cut surface 4 are used as optically recognisable features of the surface character for identification of the strand section 2. In this example, the whole cut surface is used as the identification surface. However, in the case of large cut surfaces, e.g. of slabs, only parts of the cut surface can be used as the identification surface.

A first camera 6 is arranged behind a heat protection shield 8 which can moved like a slider and aligned onto the identification surface. Instead of the heat protection shield 8, the camera 6 can also be arranged on a moving device. To illuminate the identification surface, one or more lamps 9 are connected to the camera 6. The light strength of the artificial light is set so that the light effect of daylight is excluded.

The digitized picture form the first camera is stored in the database 10. All identification data, in particular all quality-related identification data of the monitoring system 12 of the continuous casting plant, is fed to the database 10 and assigned to the cut strand section 2. The strand section 2 which is identified by the digitised picture is then fed to a sorting point for a subsequent manufacturing process, or to temporary storage.

In the sorting point 13, a second digitised picture is obtained using the second camera 14, and used in the database 10 to identify the strand section 2. The identification takes place in the database 10 by comparing the digitised pictures from the second camera 14 with this digitised pictures from the first camera 6, which are stored in the database 10.

To obtain high-definition pictures, auxiliary devices to adjust the distance between camera and identification surface are provided. Such an auxiliary device can consist of a height-adjustable positioning device 49 for the strand section 2, a distance measuring device connected to the camera, or an automatic focusing system which is integrated into a camera.

Between the picture being made by the first camera 6 and the picture being made by the second camera 14, in general the temperature of the strand section 2 changes. To exclude such temperature effects, filters 16 are arranged between the identification surface and the and second cameras 6, 14, to filter out a spectrum.

If the identification of the strand section 2 by the comparison method in the database 10 is complete, the identification data is fed to the monitoring system 18 of the rolling mill. The digitised pictures of strand sections which have been identified in the sorting point are marked in the database or removed from the database.

Figure 2:
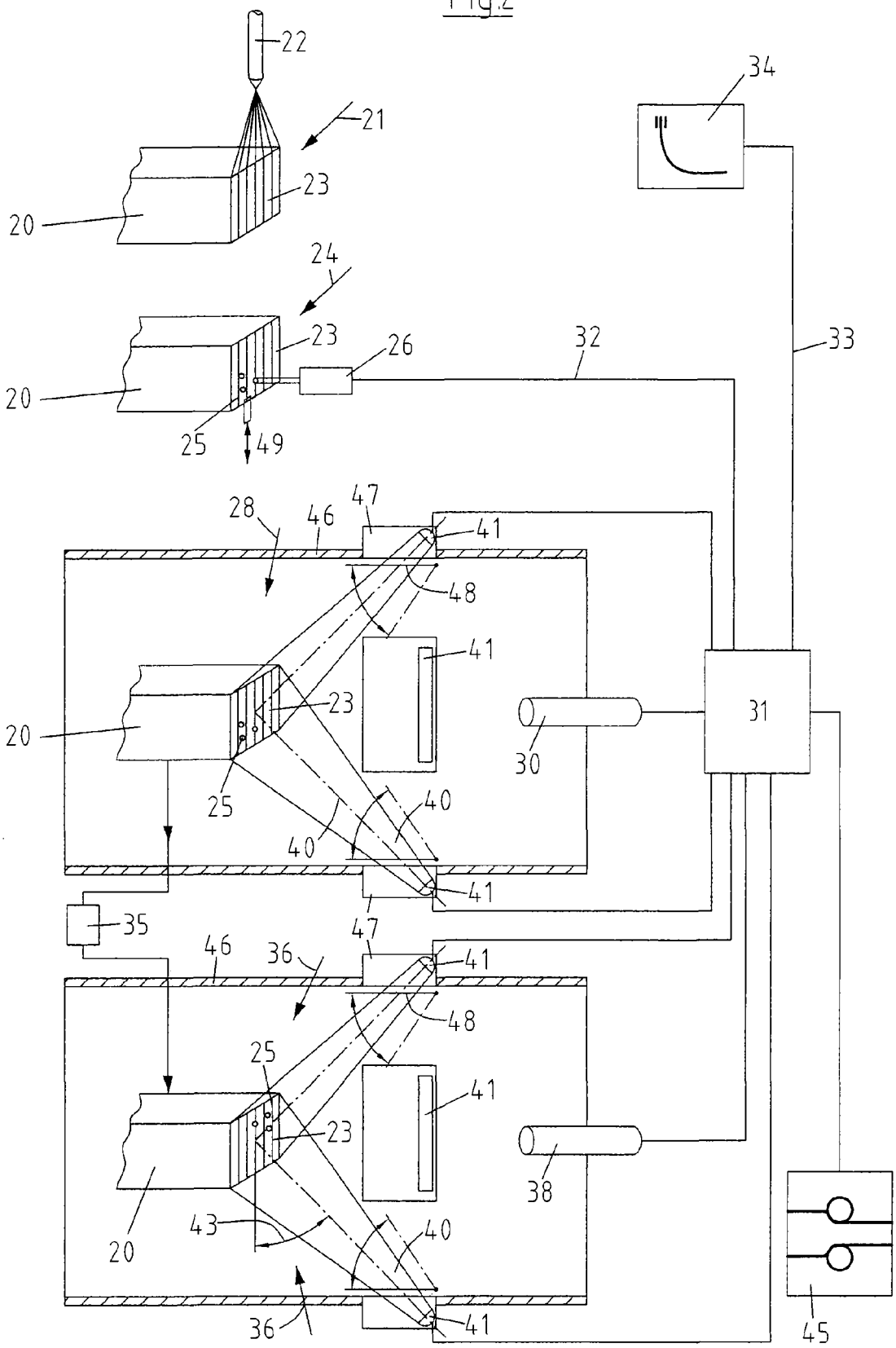
FIG. 2 shows a schematic representation a device for identifying products according to other embodiments of the invention.

In FIG. 2, a strand section 20 is shown in a flame cutting station 21. A separating cut has been made by means of a flame cutter 22. On a cut surface 23, which is used as the identification surface, optically recognisable identification features have been generated by the flame cut. In the flame cutting station 21 or a subsequent station 24, additional optically recognisable surface features 25 are applied to the cut surface 23. Such features 25 can consist of simple holes, special symbols, alphanumeric symbols, bar codes or colour patterns, etc. Such optically recognisable additional features have a variety of purposes. For instance, they can represent additional distinguishing features for strand sections, and these features can be recognisable by the human eye and make presorting possible, e.g. in a storage area. Additionally, however, they can also represent only the momentary position of a strand section or its identification surface to a camera 30. For comparison of the first and second pictures, it is advantageous if in the case of round or square cross-section, the position of the strand section to the camera is uniquely defined by such a surface feature before a picture comparison. A device to apply such additional features is shown schematically at 26. In the subsequent identification station 28, a digitised picture of the cut surface 23 is taken by a first camera 30 and fed to a database 31. This database also receives signals 32 of the device 26 and the relevant parameters 33 of the casting process monitoring 34.

From the identification station 28, the strand section 20 can be fed to a storage area 35 or directly to a sorting station 36 for further processing. To identify and sort the strand sections 20, digitised pictures of the cut surface 23 are taken by a second camera 38. In this example, the additional features 25 indicate that the strand section 20 has entered the sorting station 36 titled by 180° compared with the station 24 and identification station 28. The digitised pictures from the camera 38 are therefore also rotated by 180° when they are stored in the database for comparison evaluation. When the identification of the strand section 20 by the comparison method is complete, all relevant parameters of the casting process are fed to a process controller 45 of a rolling mill with the identified strand section 20.

As well as the essentially shadow-free illumination by means of lamps 9 as show in FIG. 1, it is also possible to control the light incidence on the identification surface in such a way that unevennesses stand out more because of cast shadows, and thus additional identification features are created. The more flatly the artificial light falls on the identification surface, the darker the cast shadows become. In FIG. 2, illumination which falls diagonally on the identification surface is represented by a light beam 40 and lamp 41. The choice of the position of the illumination, e.g. from above or below, and the choice of an angle of incidence 43 of light onto the cut surface 23 is defined in the database 31, together with the digitised picture. For instance, if the strand section 20 enters the sorting station 36 titled by 180°, as shown in FIG. 2, the light incidence is adjusted accordingly.

Taking the digitised pictures and storing them in the database 31 requires only fractions of seconds. To increase the reliability of identification, it is possible to store digitised pictures of the cut surface 23 in the database in succession, with different angles of incidence 43 of light. With two or more digitised pictures of the same cut surface 23, but with different directions of light incidence, the reliability of identification is increased without significant loss of time and without causing increased cost.

In FIG. 2, a screen 46 against external light sources, in the form of a tunnel or tube body, is arranged in the identification station 28 and sorting station 36. In this screen 46, light sources 41 are housed in niches 47 on all four sides of the tunnel. These niches can be closed by flaps 48 for protection against heat radiation. The four light sources 41 make it possible to obtain four pictures in succession light being applied to the identification surface from a different direction for each picture. Because the shadows are thrown differently by each light source, the result is four different pictures of the same identification surface.

To obtain pictures in the screen 46, the strand section 20 can be moved into the screen 46 and fixed against a limit stop 49, or the screen 46 moves, together with the camera, toward the strand section. For precise distance setting between the cut surface 23 and the camera 38, even in the case of this embodiment a distance measuring device which is known in the prior art, or an automatic focusing system, can be used.

Pictures from the first camera which are stored in the database and have resulted in identification of a strand section are marked in the database or removed from the database.

Instead of strand sections 2, 20 as described in the embodiments, automated identification can also be used for semi-finished products in other parts of a steel mill.

Those skilled in the art will recognize that the materials and methods of the present invention will have various other uses in addition to the above described embodiments. They will appreciate that the foregoing specification and accompanying drawings are set forth by way of illustration and not limitation of the invention. It will further be appreciated that various modifications and changes may be made therein without departing from the spirit and scope of the present invention, which is to be limited solely by the scope of the appended claims.

What is claimed is:

1. Method of identifying of a product, comprising:

providing a product having a cut surface with at least one optically recognizable surface feature as a result of cutting thereof;

using a processor for implementing the steps of:

obtaining at least one first images of an identification surface comprising at least a portion of the cut surface and containing the at least one optically-recognizable surface feature;

storing the first images in a database;

obtaining at least one second images of the identification surface at a later time;

comparing the first images and the second images to identify the product.

2. Method of claim 1, wherein the at least one optically recognizable surface feature comprises at least one of the geometry of the identification surface, surface roughness, surface texture, surface microstructural properties and cut-specific surface features.

3. Method of claim 1, further comprising the steps of assigning identification data to the first images in the database prior to obtaining the second images and retrieving the identification data from the database after comparing the first images and second images.

4. Method of claim 3, wherein the identification data comprises at least one of casting process parameters and quality-related parameter of the product.

5. Method according to claim 3, wherein the size of the identification surface is equal to the size of the cut surface, the identification data includes the size of the cut surface, and the size of the cut surface is used to identify the first images stored in the database for comparison to the second images.

6. Method of processing a product, comprising:

identifying a product according to the method of claim 3; and utilizing to the retrieved identification data to process the product.

7. Method according to claim 1, wherein the first images and the second images are obtained by a camera, and a light spectrum filter is located between the identification surface and the camera.

8. Method of claim 1, wherein the first images and the second images are digitized.

9. Method according to claim 1, wherein the step of providing a product comprises providing a product having a cut surface cut by one of a shearing machine and a flame cutter.

10. Method according to claim 1, further comprising applying at least one additional optically-recognizable surface feature to the identification surface prior to obtaining the first images.

11. Method according to claim 10, wherein the at least one additional optically recognizable surface feature comprises at least one of a color pattern, rust protection pattern, mechanically generated embossed pattern, and positional orientation markings.

12. Method according to claim 1, wherein the step of obtaining the first images and the second images includes illuminating the identification surface with artificial light.

13. Method according to claim 12, wherein the artificial light illuminates the identification surface with an angle of incidence of between about 8° and about 45°.

14. Method according to claim 13, wherein the angle of incidence is between about 12° and about 35°.

15. Method according to claim 12, comprising obtaining a plurality of first images, each obtained with the artificial light illuminating the identification surface from a different direction, and obtaining a plurality of second images with the artificial light illuminating the identification surface from corresponding directions.

16. Apparatus for identifying a product having a cut surface with at least one optically recognizable surface feature as a result of cutting thereof, comprising:

a database adapted to store images;

a first station having a first camera operably connected to the database and configured to (i) be aligned with an identification surface comprising at least a portion of the cut surface containing the at least one optically recognizable surface feature, (ii) obtain at least one first images of the identification surface, and (iii) feed the at least one first images to the database;

a second station having a second camera operably connected to the database and configured to (i) be aligned with the identification surface in a same alignment as the first camera, (ii) obtain at least one second images of the identification surface, and (iii) feed the at least one second images to the database;

the database being further configured to compare said first images and second images and identify the product thereby.

17. Apparatus of claim 16, wherein the database is further configured to assign identification data to the first images in the database and to retrieve the identification data from the database after comparing the first images and second images.

18. Apparatus according to claim 16, wherein the at least one optically recognizable surface feature comprises at least one of the geometry of the identification surface, surface roughness, surface texture, surface microstructural properties and cut-specific surface features.

19. Apparatus according to claim 16, further comprising a device to apply at least one additional optically recognizable surface features to the identification surface.

20. Apparatus according to claim 19, wherein the at least one additional optically recognizable surface feature comprises at least one of a color pattern, rust protection pattern, mechanically generated embossed pattern, and positional orientation markings.

21. Apparatus according to claim 16, wherein the first station and second station each contain at least one light source adapted to illuminate the identification surface with a predeterminable angle of incidence of light.

22. Apparatus according to claim 21, wherein the angle of incidence of is between about 8° and about 45°.

23. Apparatus according to claim 22, wherein the angle of incidence is between about 12° and about 35°.

24. Apparatus according to claim 21, wherein the first station and the second station each contain a plurality of said light sources.

25. Apparatus according to claim 16, wherein the first station and the second station further comprise a screen for external light sources.

26. Apparatus according to claim 16, wherein the first station and second station each further comprise a filter arranged between the identification surface and the camera thereof to filter out a light spectrum.

* * * * *